US006513706B1

(12) United States Patent
Kuca

(10) Patent No.: US 6,513,706 B1
(45) Date of Patent: Feb. 4, 2003

(54) MAILBOX APPARATUS

(76) Inventor: John A. Kuca, 117 Pilot Mountain Rd., Lancing, TN (US) 37770

( * ) Notice: Subject to any disclaimer, the term of this patent is extended or adjusted under 35 U.S.C. 154(b) by 0 days.

(21) Appl. No.: 10/056,451

(22) Filed: Jan. 25, 2002

(51) Int. Cl.[7] ..... B65D 91/00
(52) U.S. Cl. ..... 232/35; 340/569; 232/34
(58) Field of Search ..... 232/35, 34, 36; 340/569

(56) References Cited

U.S. PATENT DOCUMENTS

| | | | | |
|---|---|---|---|---|
| 3,572,581 A | | 3/1971 | Mc Leod | |
| 4,163,225 A | | 7/1979 | Engel | |
| 4,182,479 A | | 1/1980 | Swift | |
| 4,287,514 A | | 9/1981 | Wartman et al. | |
| 4,520,350 A | * | 5/1985 | Huang | 340/569 |
| 5,060,854 A | * | 10/1991 | Armstrong | 232/37 |
| D335,747 S | | 5/1993 | Dearing et al. | |
| 5,335,848 A | * | 8/1994 | Schreiber | 232/34 |
| 5,950,919 A | * | 9/1999 | Adams | 232/34 |
| 5,954,264 A | | 9/1999 | Keller | |

* cited by examiner

*Primary Examiner*—William L. Miller

(57) ABSTRACT

A mailbox apparatus includes a flag support assembly being mounted to a mailbox assembly and a housing attached to the mailbox. Aflag support arm is movably disposed in the housing. A spring member biases the flag support arm. A flag member is pivotally attached to the housing such that it contacts the flag support arm. A mail delivery signaling assembly including a switch member being disposed in the housing and being in contactable relationship to the flag support arm, and also including a light-emitting member being connected to the switch member with wires, and further including a pressure sensitive sensor being disposed in the box and being connected to the light-emitting member, and also including a power source being connected to the switch member, to the light-emitting member, and to the pressure sensitive sensor.

7 Claims, 4 Drawing Sheets

MAILBOX APPARATUS

BACKGROUND OF THE INVENTION

1. Field of the Invention

The present invention relates to mailboxes and more particularly pertains to a new mailbox apparatus for preventing the flag member from falling down and also notifying the user of delivered mail.

2. Description of the Prior Art

The use of mailboxes is known in the prior art. More specifically, mailboxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,954,264; U.S. Pat. No. 4,287,514; U.S. Pat. No. 3,572,581; U.S. Pat. No. 4,182,479; U.S. Pat. No. 4,163.225; and U.S. Pat. No. Des.335.747.

While these devices fulfill their respective, particular objectives and requirements, the aforementioned patents do not disclose a new mailbox apparatus. The inventive device includes a mailbox assembly including a box having an open front end, and also includes a door being hingedly attached to the box and being closable over the open front end, and further includes a tubular support member upon which the box is mounted; and also includes a flag Support assembly being mounted to the mailbox assembly and including a housing being attached to the box, and also including a flag support arm being movably disposed in the housing, and further including a spring member being disposed in the housing and biasing the flag support arm; and further includes a flag member being pivotally attached to the housing and having a bottom end which is in contactable relationship to the flag support arm; and also includes a mail delivery signaling assembly including a switch member being disposed in the housing and being in contactable relationship to the flag support arm, and also including a light-emitting member being connected to the switch member with wires, and further including a pressure sensitive sensor being disposed in the box and being connected to the light-emitting member, and also including a power source being connected to the switch member, to the light-emitting member, and to the pressure sensitive sensor.

In these respects, the mailbox apparatus according to the present invention substantially departs from the conventional concepts and designs of the prior art, and in so doing provides an apparatus primarily developed for the purpose of preventing the flag member from falling down and also notifying the user of delivered mail.

SUMMARY OF THE INVENTION

In view of the foregoing disadvantages inherent in the known types of mailboxes now present in the prior art, the present invention provides a new mailbox apparatus construction wherein the same can be utilized for preventing the flag member from falling down and also notifying the user of delivered mail.

The general purpose of the present invention, which will be described subsequently in greater detail, is to provide a new mailbox apparatus apparatus and method which has many of the advantages of the mailboxes mentioned heretofore and many novel features that result in a new mailbox apparatus which is not anticipated, rendered obvious, suggested, or even implied by any of the prior art mailboxes, either alone or in any combination thereof.

To attain this, the present invention generally comprises a mailbox assembly including a box having an open front end, and also includes a door being hingedly attached to the box and being closable over the open front end, and further includes a tubular support member upon which the box is mounted; and also includes a flag support assembly being mounted to the mailbox assembly and including a housing being attached to the box, and also including a flag support arm being movably disposed in the housing, and further including a spring member being disposed in the housing and biasing the flag support arm; and further includes a flag member being pivotally attached to the housing and having a bottom end which is in contactable relationship to the flag support arm; and also includes a mail delivery signaling assembly including a switch member being disposed in the housing and being in contactable relationship to the flag support arm, and also including a light-emitting member being connected to the switch member with wires, and further including a pressure sensitive sensor being disposed in the box and being connected to the light-emitting member, and also including a power source being connected to the switch member, to the light-emitting member, and to the pressure sensitive sensor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As Such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mailbox apparatus apparatus and method which has many of the advantages of the mailboxes mentioned heretofore and many novel features that result in a new mailbox apparatus which is not anticipated, rendered obvious, suggested, or even implied by any of the prior art mailboxes, either alone or in any combination thereof.

It is another object of the present invention to provide a new mailbox apparatus which may be easily and efficiently manufactured and marketed.

It is a further object of the present invention to provide a new mailbox apparatus which is of a durable and reliable construction.

An even further object of the present invention is to provide a new mailbox apparatus which is susceptible of a low cost of manufacture with regard to both materials and labor, and which accordingly is then susceptible of low prices of sale to the consuming public, thereby making such mailbox apparatus economically available to the buying public.

Still yet another object of the present invention is to provide a new mailbox apparatus which provides in the apparatuses and methods of the prior art some of the advantages thereof, while simultaneously overcoming some of the disadvantages normally associated therewith.

Still another object of the present invention is to provide a new mailbox apparatus for preventing the flag member from falling down and also notifying the user of delivered mail.

Yet another object of the present invention is to provide a new mailbox apparatus which includes a mailbox assembly including a box having an open front end, and also includes a door being hingedly attached to the box and being closable over the open front end, and further includes a tubular support member upon which the box is mounted; and also includes a flag support assembly being mounted to the mailbox assembly and including a housing being attached to the box, and also including a flag support arm being movably disposed in the housing, and further including a spring member being disposed in the housing and biasing the flag support arm; and further includes a flag member being pivotally attached to the housing and having a bottom end which is in contactable relationship to the flag support arm; and also includes a mail delivery signaling assembly including a switch member being disposed in the housing and being in contactable relationship to the flag support arm, and also including a light-emitting member being connected to the switch member with wires, and further including a pressure sensitive sensor being disposed in the box and being connected to the light-emitting member, and also including a power source being connected to the switch member, to the light-emitting member, and to the pressure sensitive sensor.

Still yet another object of the present invention is to provide a new mailbox apparatus that is easy and convenient to set up and use.

Even still another object of the present invention is to provide a new mailbox apparatus that keeps the flag member in an upright position until the mailperson opens the door to the box upon which the flag member automatically lowers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
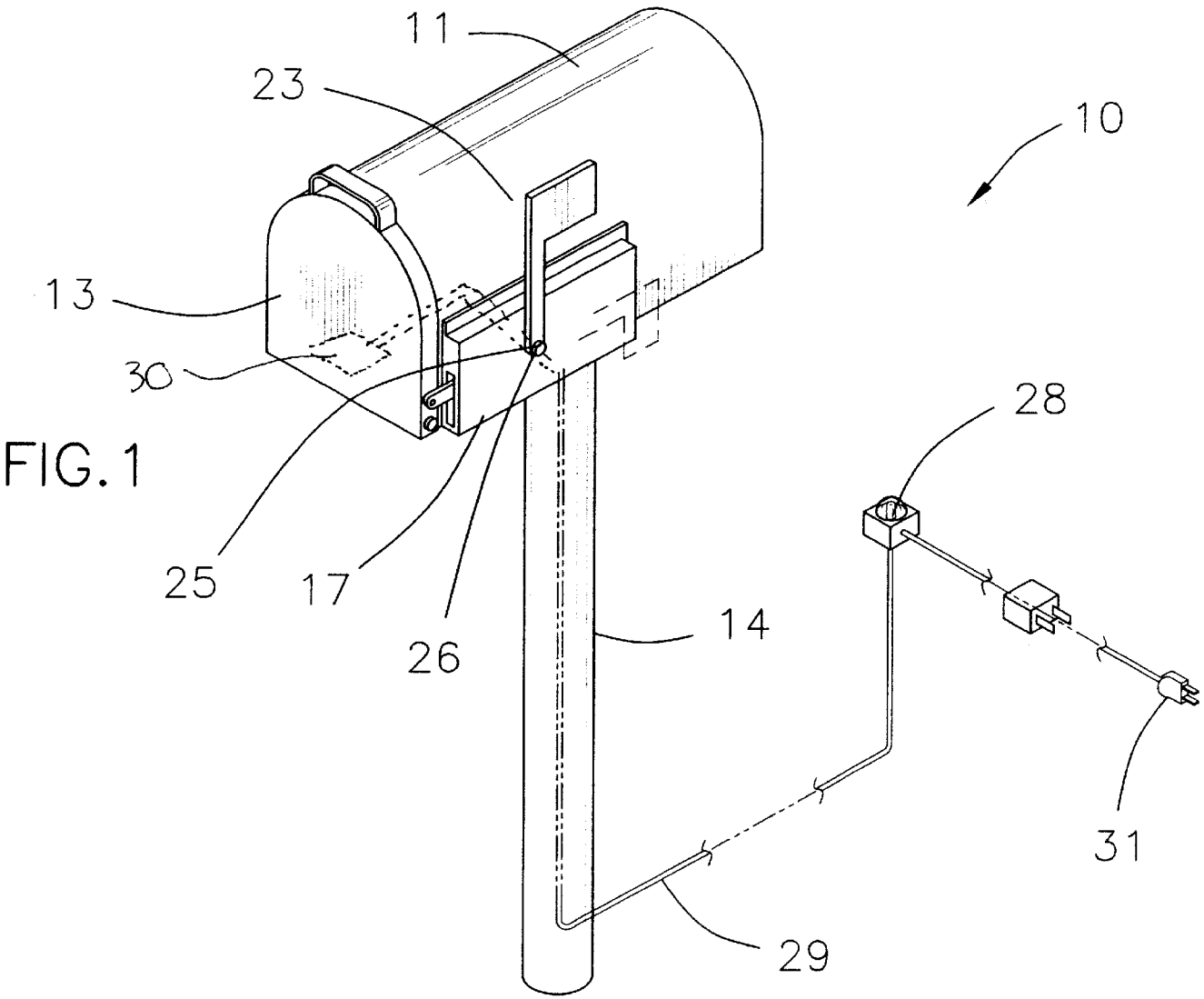
FIG. 1 is a perspective view of a new mailbox apparatus according to the present invention.
Figure 2:
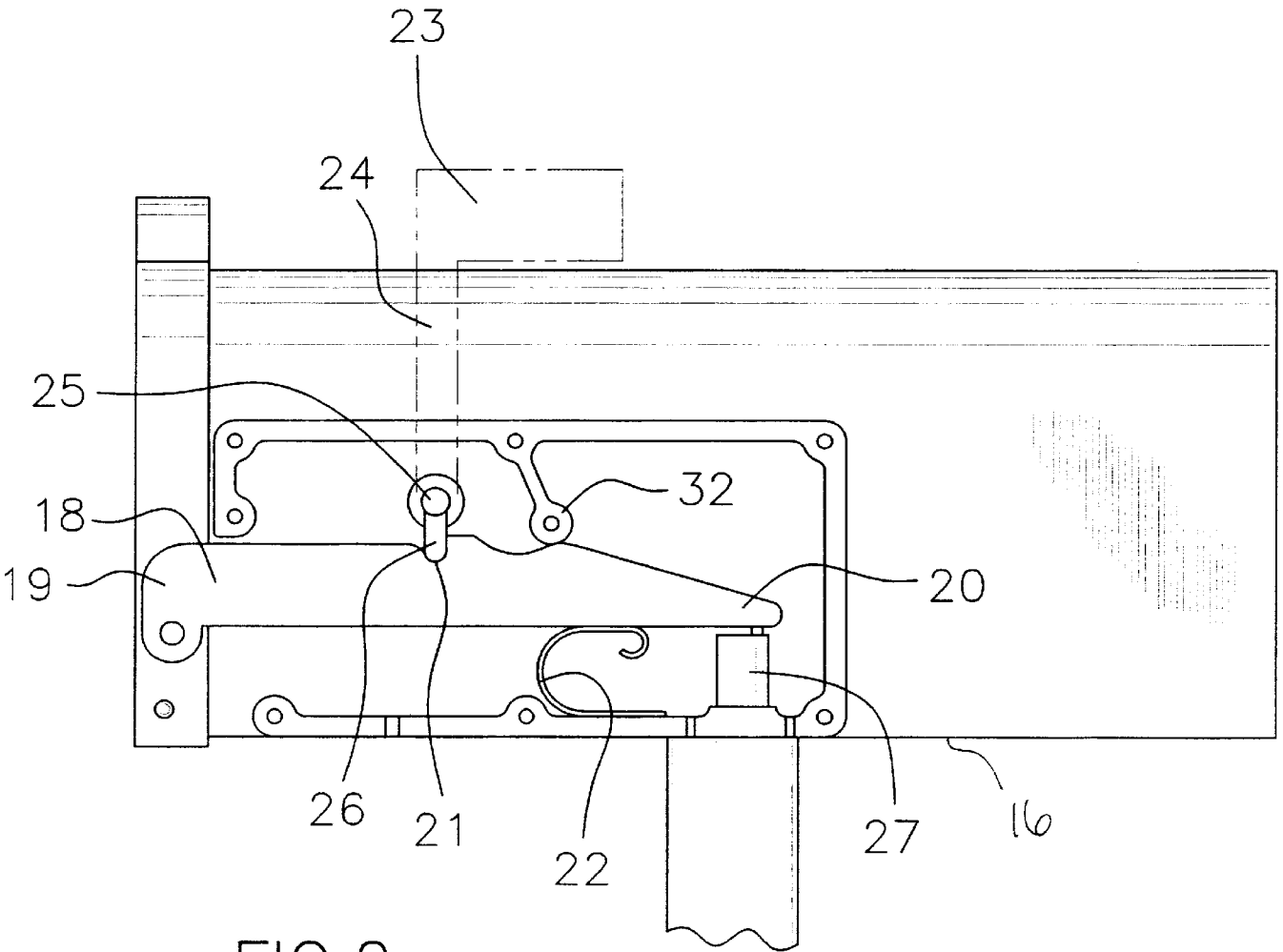
FIG. 2 is a side cross-sectional view of the present invention.
Figure 3:
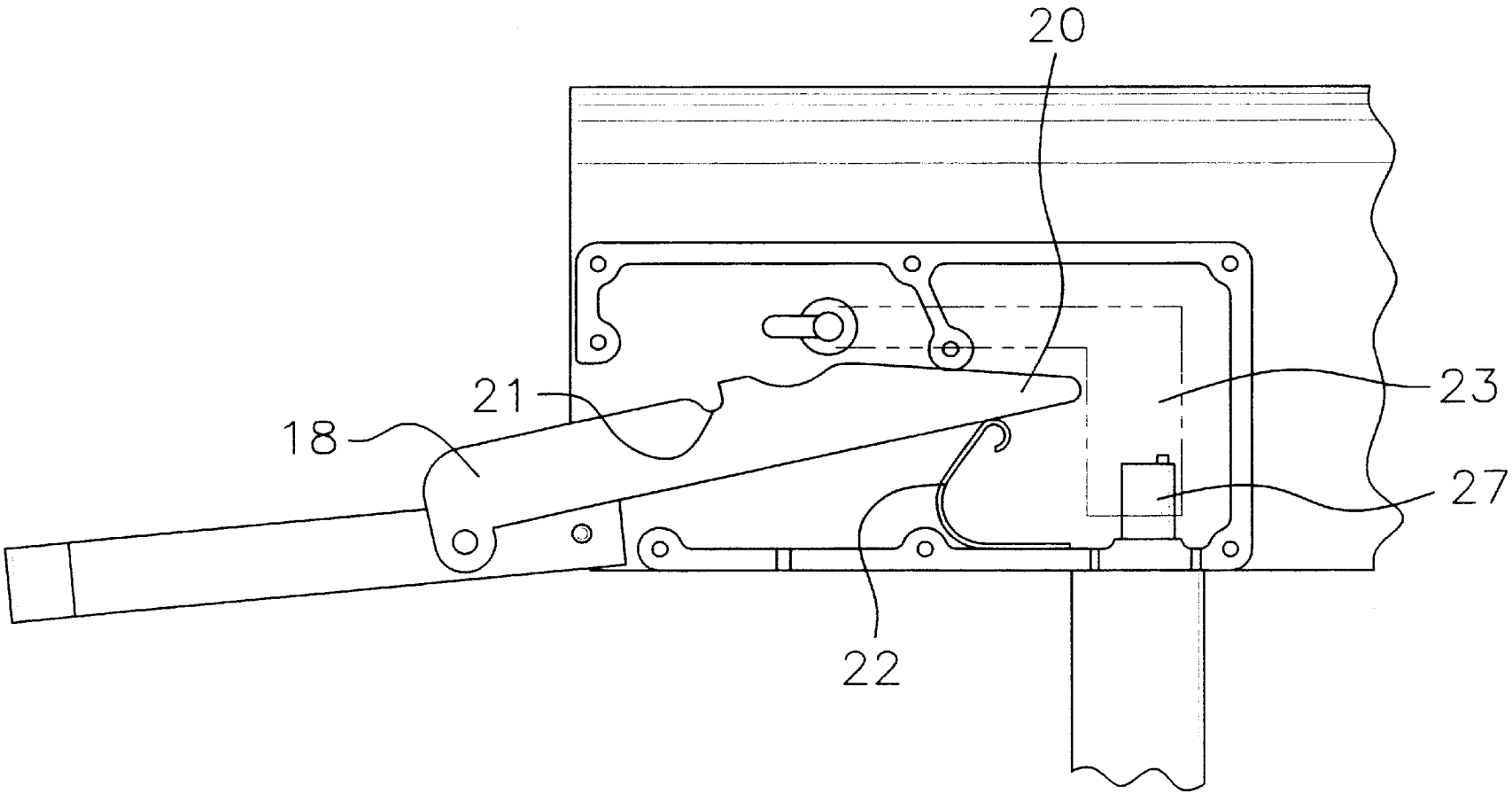
FIG. 3 is a partial side cross-sectional view of the present invention.
Figure 4:
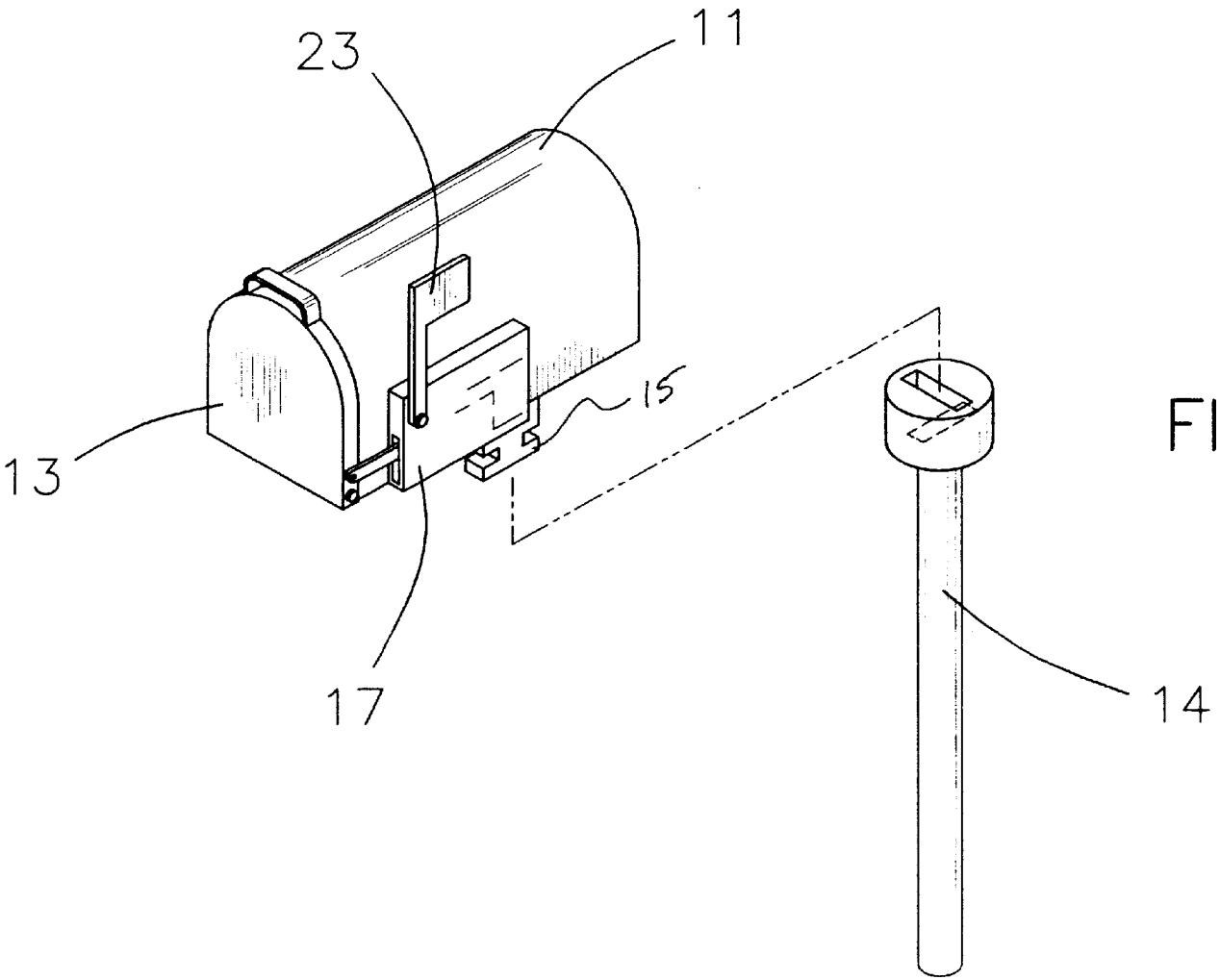
FIG. 4 is partial exploded perspective view of the present invention.

With reference now to the drawings, and in particular to FIGS. 1 through 4 thereof, a new mailbox apparatus embodying the principles and concepts of the present invention and generally designated by the reference numeral 10 will be described.

As best illustrated in FIGS. 1 through 4, the mailbox apparatus 10 generally comprises a mailbox assembly including a box 11 having an open front end 12, and also including a door 13 being hingedly and conventionally attached to the box 11 and being closable over the open front end 12, and further including a tubular support member 14 upon which the box 11 is mounted. The mailbox assembly also includes a fastening member 15 being conventionally attached to a bottom wall 16 of the box 11 and being detachably fastened to the tubular support member 14.

A flag support assembly is mounted to the mailbox assembly and includes a housing 17 being conventionally attached to the box 11, and also includes a flag support arm 18 being movably disposed in the housing 17, and further includes a spring member 22 being disposed in the housing 17 and biasing the flag support arm 18. The flag support arm 18 has a notch 21 being disposed in a longitudinal top edge thereof. The flag support arm 18 has a first end 19 which is pivotally and conventionally attached to the door 13 and also having a second end 20.

A flag member 23 is pivotally and conventionally attached to the housing 17 and has a bottom end 24 which is in contactable relationship to the flag support arm 18. The flag member 23 further includes a shaft 25 being extended through the bottom end 24 of the flag member 23 and also includes a catch member 26 being conventionally attached to the shaft 25 and being removably received in the notch 21 of the flag support arm 18 upon the door 13 being closed and the flag member 23 being raised upright.

A mail delivery signaling assembly includes a switch member 27 disposed in the housing 17 and being in contactable relationship to the flag support arm 18. The mail delivery signaling system also includes a light-emitting member 28 being operationally connected to the switch member 27 with wires 29. The mail delivery signaling assembly further includes a pressure sensitive sensor 30 being disposed in the box 11 and being connected to the light-emitting member 28 for activating the light-emitting member upon placement of mail in the box 11. A power source 31 is operationally connected to the switch member 27, the light-emitting member 28 and the pressure sensitive sensor 30. The switch member 27 is engaged with the second end 20 of the flag support arm 18 upon the door 13 being opened thus energizing the light-emitting member 28. The spring member 22 biases the flag support arm 18 out of engagement with the switch member 27. The flag support assembly further includes a flag support stop member 32 being conventionally disposed in the housing 17 to keep the flag support arm 18 proximate to the switch member 27.

In use, the user flips the flag member 23 upright with the bottom end 24 of the flag member 23 being received in the notch 21 of the flag support arm 18 to stabilize the flag member 23. Upon a mailperson opening the door 13 of the box 11, the flag support arm 18 is moved to release the flag member 23 which automatically flips downwardly and is moved to engage the switch member 27 which energizes the light-emitting member 28 to signal the user that the mailperson has been to the box 11. Alternately or in combination with the switch member 27, the pressure sensitive switch positioned in box 11 activates the light-emitting member upon placement of mail in the box 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox apparatus comprising:

a mailbox assembly including a box having an open front end, and also including a door being hingedly attached to said box and being closable over said open front end, and further including a tubular support member upon which said box is mounted;

a flag support assembly being mounted to said mailbox assembly and including a housing being attached to said box, and also including a flag support arm being movably disposed in said housing, and further including a spring member being disposed in said housing and biasing said flag support arm;

a flag member being pivotally attached to said housing and having a bottom end which is in contactable relationship to said flag support arm; and a mail delivery signaling assembly including a switch member being disposed in said housing and being in contactable relationship to said flag support arm, and also including a light-emitting member being connected to said switch member with wires, and further including a pressure sensitive sensor being disposed in said box and being connected to said light-emitting member, and also including a power source being connected to said switch member, to said light-emitting member, and to said pressure sensitive sensor.

2. A mailbox apparatus as described in claim 1, wherein said mailbox assembly also includes a fastening member being attached to a bottom wall of said box and being detachably fastened to said tubular support member.

3. A mailbox apparatus as described in claim 1, wherein said flag support arm has a notch being disposed in a longitudinal top edge thereof, said flag support arm having a first end which is pivotally attached to said door and also having a second end.

4. A mailbox apparatus as described in claim 3, wherein said flag member further includes a shaft being extended through said bottom end of said flag member and also includes a catch member being attached to said shaft and being removably received in said notch of said flag support arm upon said door being closed and said flag member being raised upright.

5. A mailbox apparatus as described in claim 3, wherein said switch member is engaged with said second end of said flag support arm upon said door being opened thus energizing said light-emitting member, said spring member biasing said flag support arm out of engagement with said switch member.

6. A mailbox apparatus as described in claim 1, wherein said flag support assembly further includes a flag support stop member being disposed in said housing to keep said flag support arm proximate to said switch member.

7. A mailbox apparatus comprising:

a mailbox assembly including a box having an open front end, and also including a door being hingedly attached to said box and being closable over said open front end, and further including a tubular support member upon which said box is mounted, said mailbox assembly also including a fastening member being attached to a bottom wall of said box and being detachably fastened to said tubular support member;

a flag support assembly being mounted to said mailbox assembly and including a housing being attached to said box, and also including a flag support arm being movably disposed in said housing, and further including a spring member being disposed in said housing and biasing said flag support arm, said flag support arm having a notch being disposed in a longitudinal top edge thereof, said flag support arm having a first end which is pivotally attached to said door and also having a second end;

a flag member being pivotally attached to said housing and having a bottom end which is in contactable relationship to said flag support arm, said flag member further including a shaft being extended through said bottom end of said flag member and also including a catch member being attached to said shaft and being removably received in said notch of said flag support arm upon said door being closed and said flag member being raised upright; and a mail delivery signaling assembly including a switch member being disposed in said housing and being in contactable relationship to said flag support arm, and also including a light-emitting member being connected to said switch member with wires, and further including a pressure sensitive sensor being disposed in said box and being connected to said light-emitting member, and also including a power source being connected to said switch member, to said light-emitting member, and to said pressure sensitive sensor, said switch member being engaged with said second end of said flag support arm upon said door being opened thus energizing said light-emitting member, said spring member biasing said flag support arm out of engagement with said switch member, said flag support assembly further including a flag support stop member being disposed in said housing to keep said flag support arm proximate to said switch member.

* * * * *